US009821897B1

(12) United States Patent
Veselsky et al.

(10) Patent No.: US 9,821,897 B1
(45) Date of Patent: Nov. 21, 2017

(54) RUDDER TECHNOLOGIES FOR OUTBOARD MOTORS

(71) Applicant: Edken Laboratories, LLC, St. Louis, MO (US)

(72) Inventors: Kenneth J. Veselsky, St. Louis, MO (US); Edward J. Veselsky, St. Louis, MO (US)

(73) Assignee: Edken Laboratories, LLC, St. Louis, MO (US)

( * ) Notice: Subject to any disclaimer, the term of this patent is extended or adjusted under 35 U.S.C. 154(b) by 0 days.

(21) Appl. No.: 15/441,997

(22) Filed: Feb. 24, 2017

(51) Int. Cl.

| | |
|---|---|
| ***B63H 11/117*** | (2006.01) |
| ***B63H 11/02*** | (2006.01) |
| ***B63H 20/10*** | (2006.01) |
| ***B63B 45/04*** | (2006.01) |
| ***B63H 20/34*** | (2006.01) |

(52) U.S. Cl.
CPC ..... *B63H 11/02* (2013.01); *B63B 45/04* (2013.01); *B63H 20/10* (2013.01); *B63H 20/34* (2013.01); *B63B 2751/00* (2013.01); *B63B 2758/00* (2013.01)

(58) Field of Classification Search
CPC ..... B63H 11/00; B63H 11/02; B63H 20/10; B63H 20/12; B63H 20/32; B63H 20/34; B63H 25/46; B63H 2011/00; B63H 2020/32; B63H 2025/46; B63B 45/04; B63B 2751/00; B63B 2758/00
USPC ..... 440/38, 40, 41, 42, 43; 114/144 R, 150, 114/151, 152, 162, 163
See application file for complete search history.

(56) References Cited

U.S. PATENT DOCUMENTS

| | | | | |
|---|---|---|---|---|
| 3,149,605 | A * | 9/1964 | Broadwell | B63B 13/00 440/51 |
| 3,482,402 | A * | 12/1969 | Anthoney, Sr. | B63H 11/00 415/124.1 |
| 4,352,666 | A * | 10/1982 | McGowan | B63H 20/34 114/144 R |
| 4,779,553 | A * | 10/1988 | Wildhaber, Sr. | B63H 11/08 114/128 |
| 5,094,182 | A | 3/1992 | Simner | |
| 5,167,547 | A | 12/1992 | Kobayashi et al. | |
| 5,830,020 | A * | 11/1998 | Snyder | B63H 21/175 440/12 |
| 5,980,073 | A * | 11/1999 | Whipple | B60Q 1/305 362/269 |
| 6,086,437 | A | 7/2000 | Murray | |
| 6,443,785 | B1 | 9/2002 | Swartz et al. | |

(Continued)

OTHER PUBLICATIONS

Cobra Jet Steering Products for Yamaha Jet Boats, downloaded from the Internet Feb. 16, 2017, http://www.cobrajetsteering.com/index.php?option=com_content&view=article&id=135:ordering-start-yamahajetboat&catid=34:ordering&Itemid=72 (25 pages).

(Continued)

*Primary Examiner* — Daniel V Venne
(74) *Attorney, Agent, or Firm* — Dentons US LLP

(57) ABSTRACT

A device including an outboard motor including a jet outlet portion, a stabilizer plate, and a rudder, where the stabilizer plate includes a first end portion and a second end portion, where the first end portion is proximal to the jet outlet portion, where the second end portion is distal to the jet outlet portion, where the rudder extends from the stabilizer plate between the first end portion and the second end portion.

16 Claims, 13 Drawing Sheets

(56) References Cited

U.S. PATENT DOCUMENTS

| | | | | |
|---|---|---|---|---|
| 6,523,489 | B2 | 2/2003 | Simard et al. | |
| 6,561,858 | B1 | 5/2003 | Walkowiak | |
| 8,425,269 | B2 | 4/2013 | Walkowiak | |
| 8,893,639 | B1 * | 11/2014 | Crate | B63H 20/34 114/274 |
| 9,359,054 | B2 | 6/2016 | Watts et al. | |
| 2007/0202757 | A1 * | 8/2007 | Moore | B63B 39/03 440/61 R |
| 2011/0223817 | A1 | 9/2011 | Griffin | |

OTHER PUBLICATIONS

Yamaha Jet Boat Rudder, Vimeo video, published 2012, downloaded from the Internet Feb. 17, 2017, https://vimeo.com/42646830 (2 pages).

* cited by examiner

RUDDER TECHNOLOGIES FOR OUTBOARD MOTORS

TECHNICAL FIELD

Generally, this disclosure relates to watercraft. More particularly, this disclosure relates to outboard motors.

BACKGROUND

In this disclosure, where a document, an act, and/or an item of knowledge is referred to and/or discussed, then such reference and/or discussion is not an admission that the document, the act, and/or the item of knowledge and/or any combination thereof was at a priority date, publicly available, known to a public, part of common general knowledge, and/or otherwise constitutes any prior art under any applicable statutory provisions; and/or is known to be relevant to any attempt to solve any problem with which this disclosure is concerned with. Further, nothing is disclaimed.

Many boats employ outboard motors for propulsion/steering purposes. When the outboard motors include jet drives, then operating such boats can become difficult under idle or low speeds, such as when boating through a low-wake zone or when loading onto a trailer.

SUMMARY

This disclosure at least partially addresses at least one of above inefficiencies. However, this disclosure can prove useful to other technical areas. Therefore, various claims recited below should not be construed as necessarily limited to addressing any of the above inefficiencies.

According to an embodiment of this disclosure, a device comprises an outboard motor including a jet outlet portion, a stabilizer plate, and a rudder, where the stabilizer plate includes a first end portion and a second end portion, where the first end portion is proximal to the jet outlet portion, where the second end portion is distal to the jet outlet portion, where the rudder extends from the stabilizer plate between the first end portion and the second end portion.

According to an embodiment of this disclosure, a method comprises accessing an outboard motor including a jet outlet portion and a stabilizer plate, where the stabilizer plate includes a first end portion and a second end portion, where the first end portion is proximal to the jet outlet portion, where the second end portion is distal to the jet outlet portion; and coupling a rudder to the stabilizer plate between the first end portion and the second end portion.

According to an embodiment of this disclosure, a method comprises operating a boat with an outboard motor, where the outboard motor is equipped with a jet outlet portion, a stabilizer plate, and a rudder, where the stabilizer plate includes a first end portion and a second end portion, where the first end portion is proximal to the jet outlet portion, where the second end portion is distal to the jet outlet portion, where the rudder extends from the stabilizer plate between the first end portion and the second end portion.

This disclosure is embodied in various forms illustrated in a set of accompanying illustrative drawings. Note that variations are contemplated as being a part of this disclosure, limited only by a scope of various claims recited below.

BRIEF DESCRIPTION OF DRAWINGS

The set of accompanying illustrative drawings shows various example embodiments of this disclosure. Such drawings are not to be construed as necessarily limiting this disclosure. Like numbers and/or similar numbering scheme can refer to like and/or similar elements throughout.

DETAILED DESCRIPTION

Figure 1:
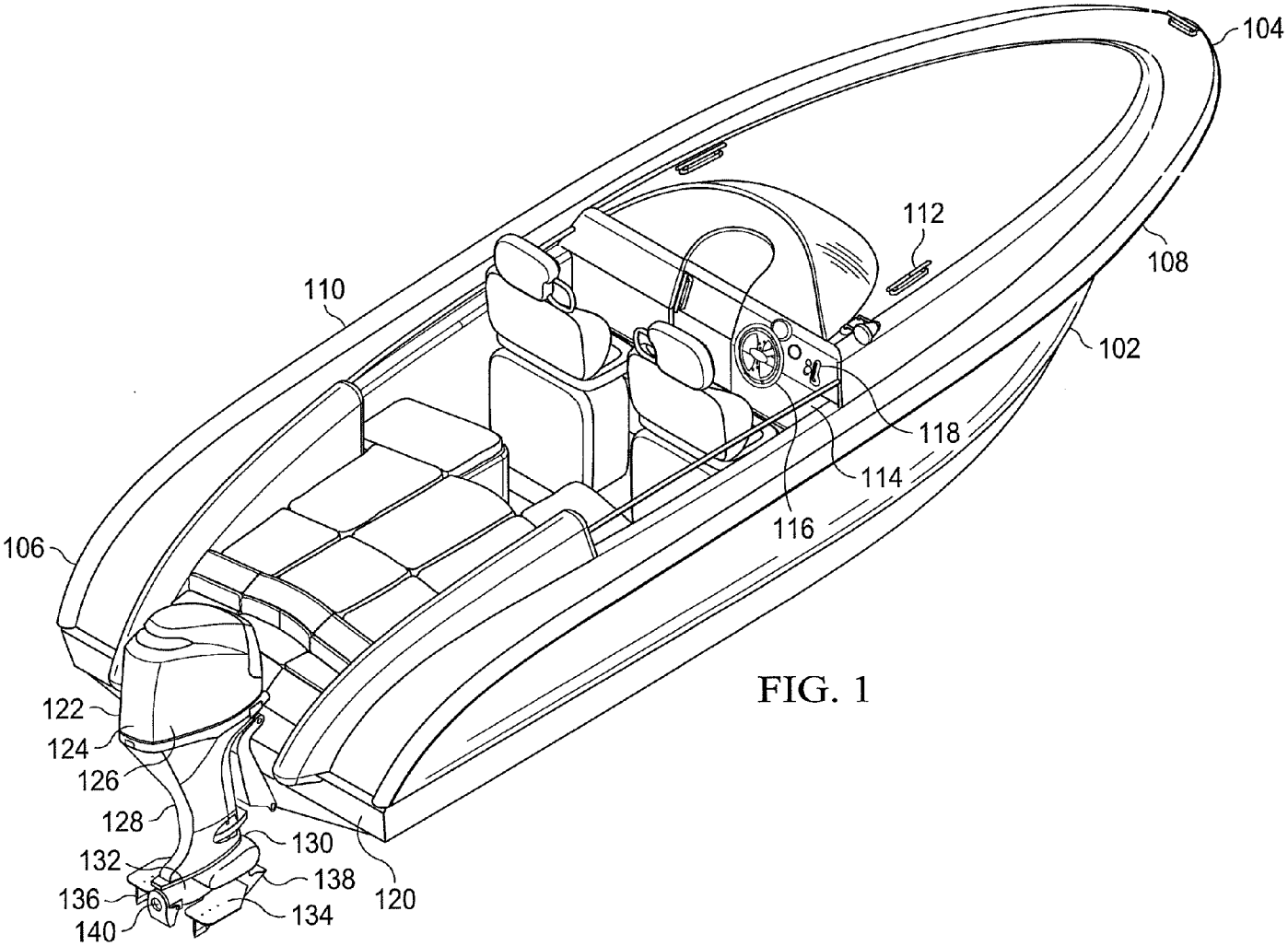
FIG. 1 shows a back perspective view of an embodiment of a boat having an outboard motor equipped with a pair of stabilizer plates and a pair of rudders according to this disclosure.

This disclosure is now described more fully with reference to the set of accompanying illustrative drawings, in which example embodiments of this disclosure are shown. This disclosure can be embodied in many different forms and should not be construed as necessarily being limited to the example embodiments disclosed herein. Rather, the example embodiments are provided so that this disclosure is thorough and complete, and fully conveys various concepts of this disclosure to those skilled in a relevant art.

Features described with respect to certain example embodiments can be combined and sub-combined in and/or with various other example embodiments. Also, different aspects and/or elements of example embodiments, as disclosed herein, can be combined and sub-combined in a similar manner as well. Further, some example embodiments, whether individually and/or collectively, can be components of a larger system, wherein other procedures can take precedence over and/or otherwise modify their application. Additionally, a number of steps can be required before, after, and/or concurrently with example embodiments, as disclosed herein. Note that any and/or all methods and/or processes, at least as disclosed herein, can be at least partially performed via at least one entity in any manner.

Various terminology used herein can imply direct or indirect, full or partial, temporary or permanent, action or inaction. For example, when an element is referred to as being "on," "connected" or "coupled" to another element, then the element can be directly on, connected or coupled to the other element and/or intervening elements can be present, including indirect and/or direct variants. In contrast, when an element is referred to as being "directly connected" or "directly coupled" to another element, there are no intervening elements present.

Although the terms first, second, etc. can be used herein to describe various elements, components, regions, layers and/or sections, these elements, components, regions, layers and/or sections should not necessarily be limited by such terms. These terms are used to distinguish one element, component, region, layer or section from another element, component, region, layer or section. Thus, a first element, component, region, layer, or section discussed below could be termed a second element, component, region, layer, or section without departing from various teachings of this disclosure.

Various terminology used herein is for describing particular example embodiments and is not intended to be necessarily limiting of this disclosure. As used herein, various singular forms "a," "an" and "the" are intended to include various plural forms as well, unless a context clearly indicates otherwise. Various terms "comprises," "includes" and/or "comprising," "including" when used in this specification, specify a presence of stated features, integers, steps, operations, elements, and/or components, but do not preclude the presence and/or addition of one or more other features, integers, steps, operations, elements, components, and/or groups thereof.

As used herein, a term "or" is intended to mean an inclusive "or" rather than an exclusive "or." That is, unless specified otherwise, or clear from context, "X employs A or B" is intended to mean any of a set of natural inclusive permutations. That is, if X employs A; X employs B; or X employs both A and B, then "X employs A or B" is satisfied under any of the foregoing instances.

Example embodiments of this disclosure are described herein with reference to illustrations of idealized embodiments (and intermediate structures) of this disclosure. As such, variations from various illustrated shapes as a result, for example, of manufacturing techniques and/or tolerances, are to be expected. Thus, various example embodiments of this disclosure should not be construed as necessarily limited to various particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing, and/or other any other types of manufacturing. For example, some manufacturing processes include three dimensional (3D) printing, laser cutting, computer numerical control routing, milling, pressing, stamping, vacuum forming, hydroforming, injection molding, lithography, and so forth.

Any and/or all elements, as disclosed herein, can be and/or include, whether partially and/or fully, a solid, including a metal, a mineral, an amorphous material, a ceramic, a glass ceramic, an organic solid, such as wood and/or a polymer, such as rubber, a composite material, a semiconductor, a nanomaterial, a biomaterial and/or any combinations thereof. Any and/or all elements, as disclosed herein, can be and/or include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, opaqueness, luminescence, reflection, phosphorescence, anti-reflection and/or holography, a photo-sensitive coating, an electronic and/or thermal property coating, such as for passivity, insulation, resistance or conduction, a magnetic coating, a water-resistant and/or waterproof coating, a scent coating and/or any combinations thereof. Any and/or all elements, as disclosed herein, can be rigid, flexible, and/or any other combinations thereof. Any and/or all elements, as disclosed herein, can be identical and/or different from each other in material, shape, size, color and/or any measurable dimension, such as length, width, height, depth, area, orientation, perimeter, volume, breadth, density, temperature, resistance, and so forth.

Unless otherwise defined, all terms (including technical and scientific terms) used herein have the same meaning as commonly understood by one of ordinary skill in an art to which this disclosure belongs. Various terms, such as those defined in commonly used dictionaries, should be interpreted as having a meaning that is consistent with a meaning in a context of a relevant art and should not be interpreted in an idealized and/or overly formal sense unless expressly so defined herein.

Furthermore, relative terms such as "below," "lower," "above," and "upper" can be used herein to describe one element's relationship to another element as illustrated in the set of accompanying illustrative drawings. Such relative terms are intended to encompass different orientations of illustrated technologies in addition to an orientation depicted in the set of accompanying illustrative drawings. For example, if a device in the set of accompanying illustrative drawings were turned over, then various elements described as being on a "lower" side of other elements would then be oriented on "upper" sides of other elements. Similarly, if a device in one of illustrative figures were turned over, then various elements described as "below" or "beneath" other elements would then be oriented "above" other elements. Therefore, various example terms "below" and "lower" can encompass both an orientation of above and below.

As used herein, a term "about" and/or "substantially" refers to a +/−10% variation from a nominal value/term. Such variation is always included in any given value/term provided herein, whether or not such variation is specifically referred thereto.

FIG. 1 shows a back perspective view of an embodiment of a boat having an outboard motor equipped with a pair of stabilizer plates and a pair of rudders according to this disclosure. In particular, a boat 100 includes a hull 102 having a bow 104 and a stern 106. The boat 100 includes a starboard side 108 and a port side 110, each spanning between the bow 104 and the stern 106. The boat 100 includes a pair of opposing cleats 112 secured to the hull 102 between the bow 104 and the stern 106, such as via fastening, clamping, mating, or other ways. The boat 100 includes a cockpit 114 between the bow 104 and the stern 106, with the cockpit 114 containing an instrument panel equipped with a steering wheel 116 and a set of input devices 118, such as buttons, levers, dials, or others, whether analog or digital. The boat 100 includes a transom 120 at the stern 106, where the transom 120 spans between the starboard side 108 and the port side 110. The boat 100 includes an outboard motor 122 that is secured to the transom 120, such as via fastening, clamping, mating, or other ways. The outboard motor 122 is controlled via the instrument panel. For example, the instrument panel can control propulsion, such as via the set of input devices 118, or steering, such as via the steering wheel 116, of the boat 100 via the outboard motor 122.

The outboard motor 122 includes a powerhead section 124, a midsection 128, and a lower unit 130, with the midsection 128 being securely interposed between the powerhead section 124 and the lower unit 130. The powerhead section 124 contains a power source, such as an internal combustion engine, which may be gasoline based, or an electric motor, which may be battery based. The powerhead section 124 includes a cowling 126 enclosing the power source and detachably attached to the powerhead section 124, such as via mating, fastening, clamping, or other ways. The midsection 128 contains a shaft which is mechanically linked, such as via a set of meshing gears, to the power source such that the shaft is able to rotate when the power source is driven. The lower unit 130 includes a jet drive containing an intake portion 138, an impeller, and a jet outlet portion 132. The impeller is rigidly mounted onto the shaft, such as within or in proximity of the jet outlet portion 132. The jet outlet portion 132 includes a nozzle 140, which is circular in shape, but may be of any closed shape, such as triangular, oval, square, rectangular, parallelogramic, trapezoidal, pentagonal, octagonal, or others. The jet outlet portion 132 is directionally adjustable along a plane generally parallel to the midsection 128, such as a vertical plane, such as up and down, although lateral adjustment is possible, such as along a plane generally perpendicular to the midsection 128, such as a horizontal plane, such as toward the starboard side 108 or the port side 110. The lower unit 130 includes a pair of stabilizer plates 134 and a pair of rudders 136. The stabilizer plates 134 outwardly extend from the lower unit 130, whether identical to or different from each other in direction or orientation, such as in T-shape manners. The rudders 136 extend from the stabilizer plates 134, whether identical to or different from each other in direction or orientation, such as generally perpendicularly. As the power source (in the powerhead section 124) drives the impeller (in the lower unit 130) through the shaft (in the midsection 128), water is (1) input, such as via negative pressure, into the intake portion 138, (2) directed toward the impeller such that the impeller impels the water toward the jet outlet portion 132, and (3) output through the nozzle 140 such that the boat 100 is propelled in a direction opposite the output of the water. Note that although the outboard motor 122 is jet drive based, in other embodiments, the outboard motor 122 is propeller based, whether additional to or alternative to the jet drive.

Figure 2:
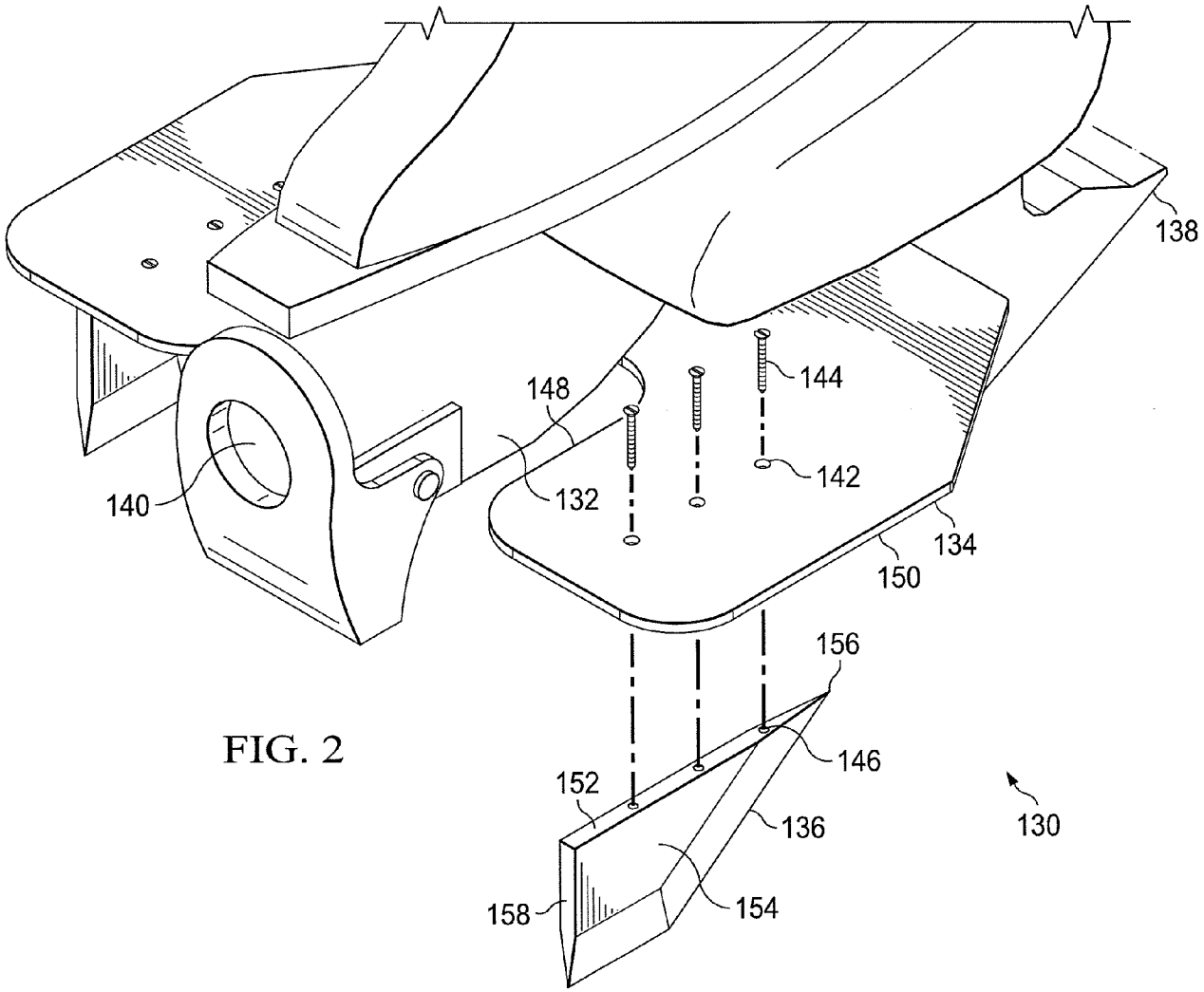
FIG. 2 shows a back perspective view of an embodiment of a lower unit of an outboard motor equipped with a pair of stabilizer plates and a pair of rudders according to this disclosure.
Figure 3:
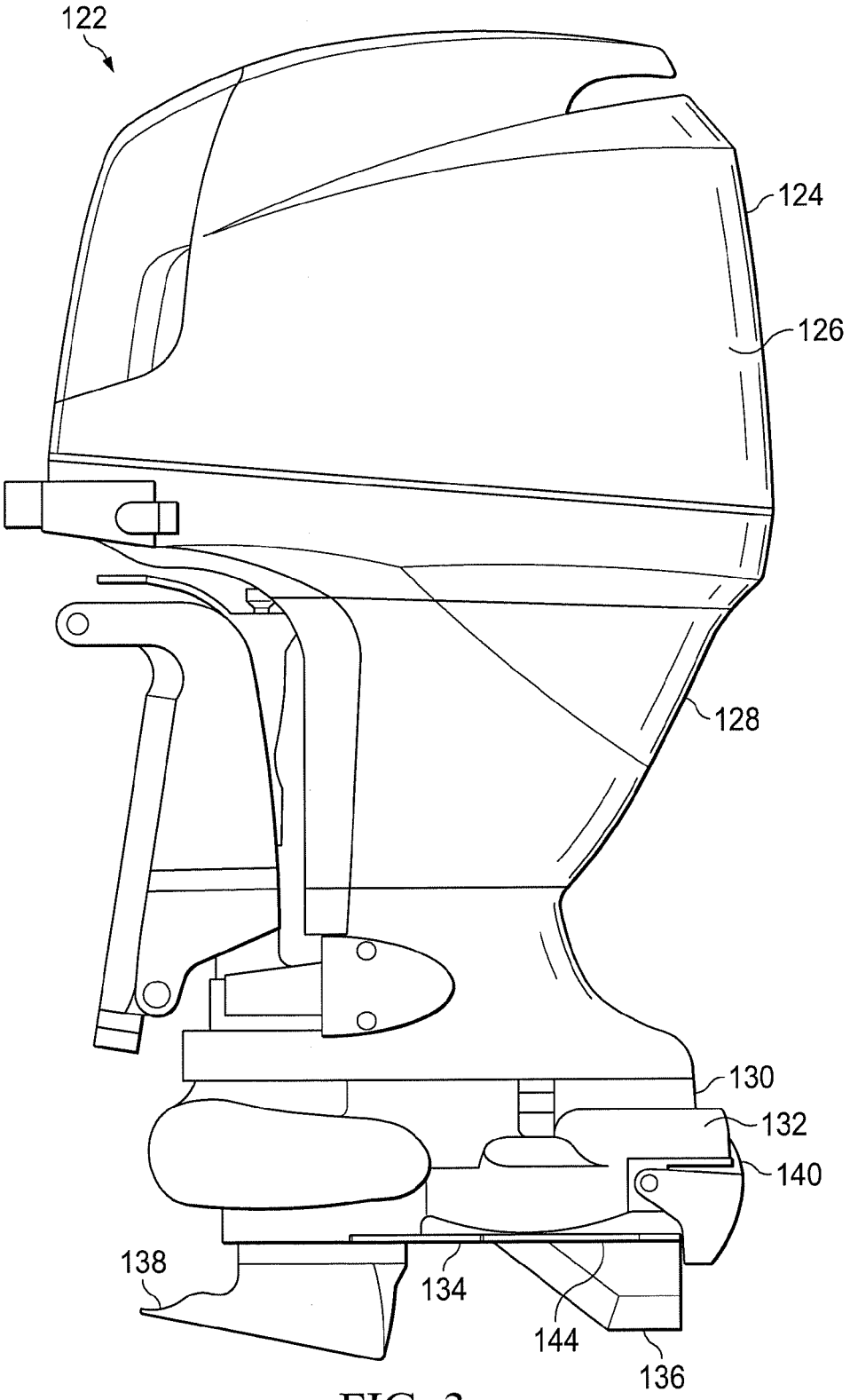
FIG. 3 shows a lateral profile view of an embodiment of an outboard motor equipped with a pair of stabilizer plates and a pair of rudders according to this disclosure.

FIG. 2 shows a back perspective view of an embodiment of a lower unit of an outboard motor equipped with a pair of stabilizer plates and a pair of rudders according to this disclosure. FIG. 3 shows a lateral profile view of an embodiment of an outboard motor equipped with a pair of stabilizer plates and a pair of rudders according to this disclosure. In particular, each of the stabilizer plates 134 includes a first end portion 148 and a second end portion 150, where the first end portion 148 and the second end portion 150 oppose each other and a respective rudder 136 extends from that stabilizer plate 134 between the first end portion 148 and the second end portion 150. The first end portion 148 is proximal to the jet outlet portion 132 and the second end portion 150 is distal to the jet outlet portion 132. Although the stabilizer plates 134 are distinct L-shaped units, the stabilizer plates 134 can be in a single unitary unit, such as a U-shaped or C-shaped unit. At least one of the stabilizer plates 134 can include any rigid or flexible, solid or perforated material suitable for water use, such as plastic, metal, rubber, wood, or others. Although the stabilizer plates 134 are identical to each other in structure, material, shape, or other characteristics, the stabilizer plates 134 can differ from each other in structure, material, shape, or other characteristics.

Each of the stabilizer plates 134 includes a set of bores 142 bored between the first end portion 148 and the second end portion 150. Although the set of bores 142 includes three bores, any number of bores may be used, such as at least one bore. Although the set of bores 142 extends rectilinearly, any non-linear, such as a closed shape, or linear, such as sinusoidal, arcuate, or others, extension is possible. Although the set of bores 142 includes three identically structured bores, any structure of bores or structure combination of bores may be used, whether identical to or different from each other in various measureable characteristics, such as in diameter, depth, shape, inner surface texture, threading (male/female), or others.

Although each of the rudders 136 is shaped as a right trapezoid, any trapezoidal structure is possible, such as acute, obtuse, or others. Likewise, non-trapezoidal structure is possible as well, such as a rectangle, a square, a semicircle/oval, a triangle, or others. Although each of the rudders 136 is cross-sectionally wedge-shaped, other cross-sectional shapes are possible, such as rectangular, circular, oval, or others. At least one of the rudders 136 can include any rigid or flexible, solid or perforated material suitable for water use, such as plastic, metal, rubber, wood, or others, whether identical to or different from the material included in at least one of the stabilizer plates 134. Although the rudders 136 are identical to each other in structure, material, shape, symmetry, or other characteristics, the rudders 136 can differ from each other in structure, material, shape, symmetry, or other characteristics.

Each of the rudders 136 includes a base 152, a pair of lateral sides 154, a leading edge portion 156, and a back portion 158, where the base 152 spans between the leading edge portion 156 and the back portion 158 and where the pair of lateral sides 154 generally perpendicularly extend from the base 152 and the back portion 158, although general non-perpendicular extension is possible, such as acute or obtuse. The leading edge portion 156 is outwardly tapered towards the pair of lateral sides 154.

The base 152 includes a set of wells 146 formed between the pair of lateral sides 154 and between the leading edge portion 156 and the back portion 158. Although the set of wells 146 includes three wells, any number of wells may be used, such as at least one well. Although the set of wells 146 extends rectilinearly, any non-linear, such as a closed shape, or linear, such as sinusoidal, arcuate, or others, extension is possible. Although the set of wells 146 includes three identically structured wells, any structure of wells or structure combination of wells may be used, whether identical to or different from each other in various measureable characteristics, such as in diameter, depth, shape, inner surface texture, threading (male/female), or others.

The rudders 136 are secured to the stabilizer plates 134 via a set of fasteners 144, whether rigid or flexible, such as screws or bolts, which may include metal, plastic, rubber, wood, or other suitable materials. Although the set of fasteners 144 includes three fasteners, any number of fasteners may be used, such as at least one fastener. Although the set of fasteners 144 includes three identically structured fasteners, any structure of fasteners or structure combination of fasteners may be used, whether identical to or different from each other in various measureable characteristics, such as in diameter, depth, shape, outer surface texture, threading (male/female), or others. Note that the rudders 136 avoid extending vertically lower than the intake portion 138, such as to allow for shallow water operation, although extending past the intake portion 138 is possible, such as for non-shallow water operation.

Although the rudders 136 are secured to the stabilizer plates 134 via the set of fasteners 144, the rudders 136 can be secured to the stabilizer plates 134 in other ways. For example, some of such ways include clamping, mating, interlocking, adhering, magnetizing, hook-and-looping, sowing, nailing, stitching, welding, casting, or any others. Additionally, the rudders 136 and the stabilizer plates 134 can also be unitary, such as a single monolithic piece.

Although the rudders 136 and the stabilizer plates 134 are in T-shape relationships, such as generally perpendicular, other relationships are possible, such as generally non-perpendicular, such as acute or obtuse. Note that at least one of the rudders 136 can extend from at least one of the stabilizer plates 134 from any point between the first end portion 148 and the second end portion 150, such as within 9/10 of that distance, within 8/10 of that distance, within 7/10 of that distance, within 6/10 of that distance, within 5/10 of that distance, within 4/10 of that distance, within 3/10 of that distance, within 2/10 of that distance, or within 1/10 of that distance, as measured between the first end portion 148 and the second end portion 150. For example, if that distance is about 10 inches, then that rudder 136 can be secured at any point within those 10 inches, such as at within 9 inches from the first end portion 148 or within 5 inches from the second end portion 150 or any others, inclusively. In some embodiments, an advantage to securing that rudder 136 between the first end portion 148 and the second end portion 150, such as within 3/4 or 2/3 of that distance, is that such structure causes less cavitation, which causes the boat 100 to rock side-to-side by air bubbles trapped under the boat 100, as produced by the water output of the outboard motor 122. Likewise, such configuration can also control the boat 100 at any speed, while effectively reducing sideways or lateral slide and water skidding while turning the boat 100. However, in some embodiments, that rudder 136 can be secured at the first end portion 148 or at the second end portion 150.

In one mode of operation, a user can access the outboard motor 122 including the jet outlet portion 132 and the stabilizer plate 134, where the stabilizer plate 134 includes the first end portion 148 and the second end portion 150, where the first end portion 148 is proximal to the jet outlet portion 132, where the second end portion 150 is distal to the jet outlet portion 132; and couple the rudder 136 to the stabilizer plate 134 between the first end portion 148 and the second end portion 150.

In one mode of operation, a user can operate the boat 100 with the outboard motor 122 where the outboard motor 122 is equipped with the jet outlet portion 132 and the stabilizer plate 134, where the stabilizer plate 134 includes the first end portion 148 and the second end portion 150, where the first end portion 148 is proximal to the jet outlet portion 132, where the second end portion 150 is distal to the jet outlet portion 132, and the rudder 136 extends from the stabilizer plate 134 between the first end portion 148 and the second end portion 150.

Figure 4:
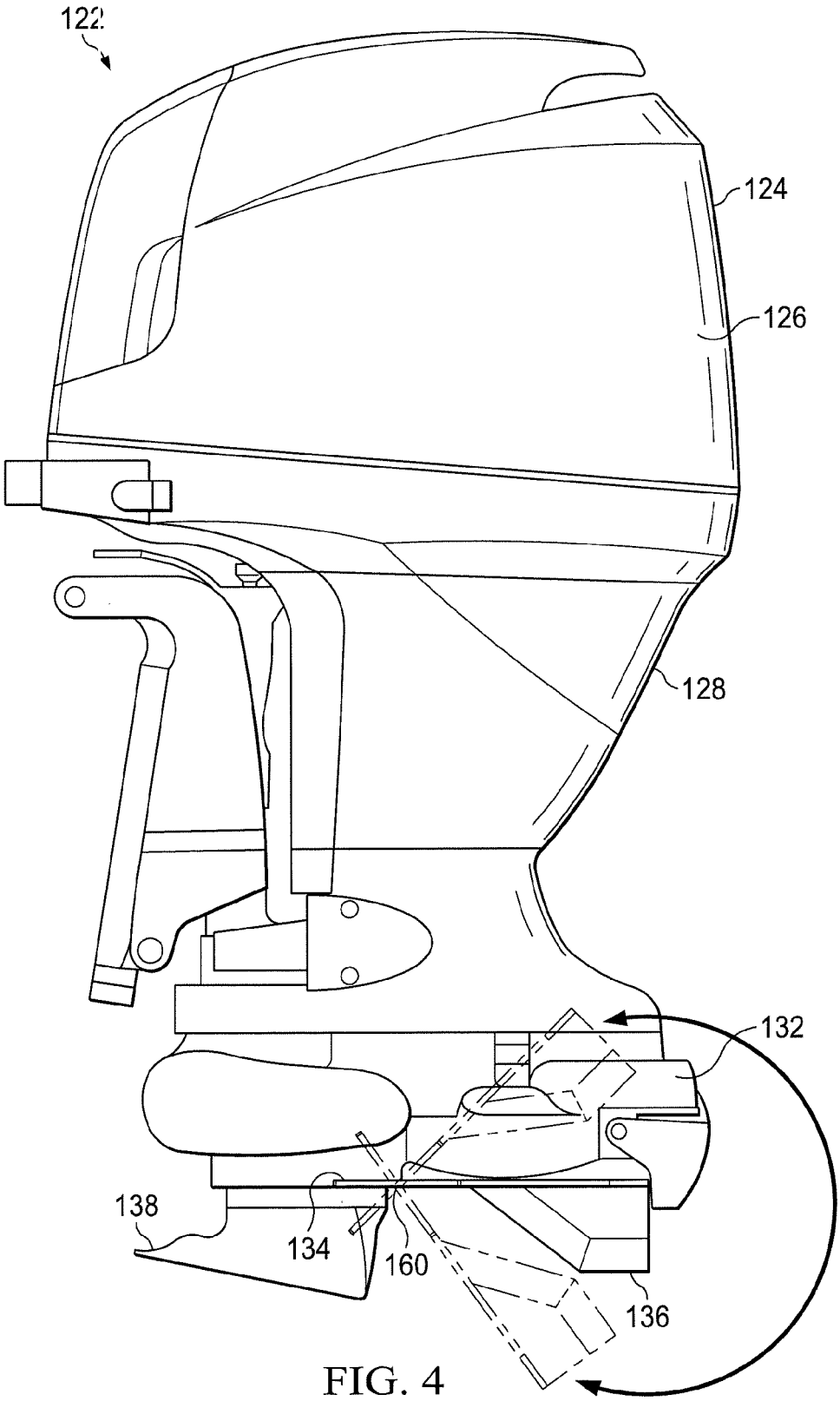
FIG. 4 shows a lateral profile view of an embodiment of an outboard motor equipped with a pair of stabilizer plates and a pair of rudders where the stabilizer plates can rotate with respect to a lower unit of the outboard motor according to this disclosure.

FIG. 4 shows a lateral profile view of an embodiment of an outboard motor equipped with a pair of stabilizer plates and a pair of rudders where the stabilizer plates can rotate with respect to a lower unit of the outboard motor according to this disclosure. In particular, the outboard motor 122 includes a pair of shafts 160 rigidly secured to the lower unit 130 on opposing sides thereof in opposing directions from each other, while extending along the transom 120, such that the shafts 160 can be independently or dependently, synchronously or asynchronously driven by the power source enclosed via the cowling 126 and independently or dependently, synchronously or asynchronously controllably rotated about their respective axes, such as within a predefined rotation range, such as between about 0 and about 90 degrees, although higher amounts are possible, such as about 360 degrees, or freely rotate. The shafts 160 can avoid extending out of the lower unit 130 or extend out of the lower unit 130. The shafts 160 can be rigid or flexible, solid or perforated and include any suitable material, such as plastic, metal, rubber, wood, or others. The stabilizer plates 134 are rigidly secured to the shafts 160 at any points thereof, such as external to the lower unit 130. As such, when the shafts 160 controllably rotate about their axes, the stabilizer plates 134 are moved clockwise or counterclockwise, such as up or down, as illustrated in FIG. 4.

Note that this controlled movement is independently or dependently, synchronously or asynchronously controlled at the instrument panel, such as via the set of input devices 118, such as via a set of hydraulic equipment, a set of pneumatic equipment, a set of cables, a set of meshing gears, or any other actuation technology within the boat 100 and within the outboard motor 122 and can be manually powered or, as noted above, independently or dependently, synchronously or asynchronously powered via the power source enclosed via the cowling 126. Further, note that this controlled movement can be manually synchronously or asynchronously controlled, such as via the set of input devices 118, or automatically synchronously or asynchronously controlled, such as a processing circuit, whether local to or remote from the boat 100 or the outboard motor 122, such as based on a set of data feeds from a set of input devices, whether local to or remote from the boat 100 or the outboard motor 122, such as a camera, a sonar, a radar, an ultrasonic sensor, a laser, or others. In some embodiments, a single shaft 160 is used, where the stabilizer plates 134 are secured thereto and the single shaft 160 spans laterally along the transom 120 through the lower unit 130 and extends outside of the lower unit 130 on both sides in opposing directions to which the stabilizer plates 134 are attached, which may be removably. In some embodiments, the rudders 136 extend from the shaft(s) 160, without the stabilizer plates 134, such as assembled, such as via fastening, mating, adhering, or others, including any assembling methodology disclosed herewith, or unitary therewith.

Figure 5:
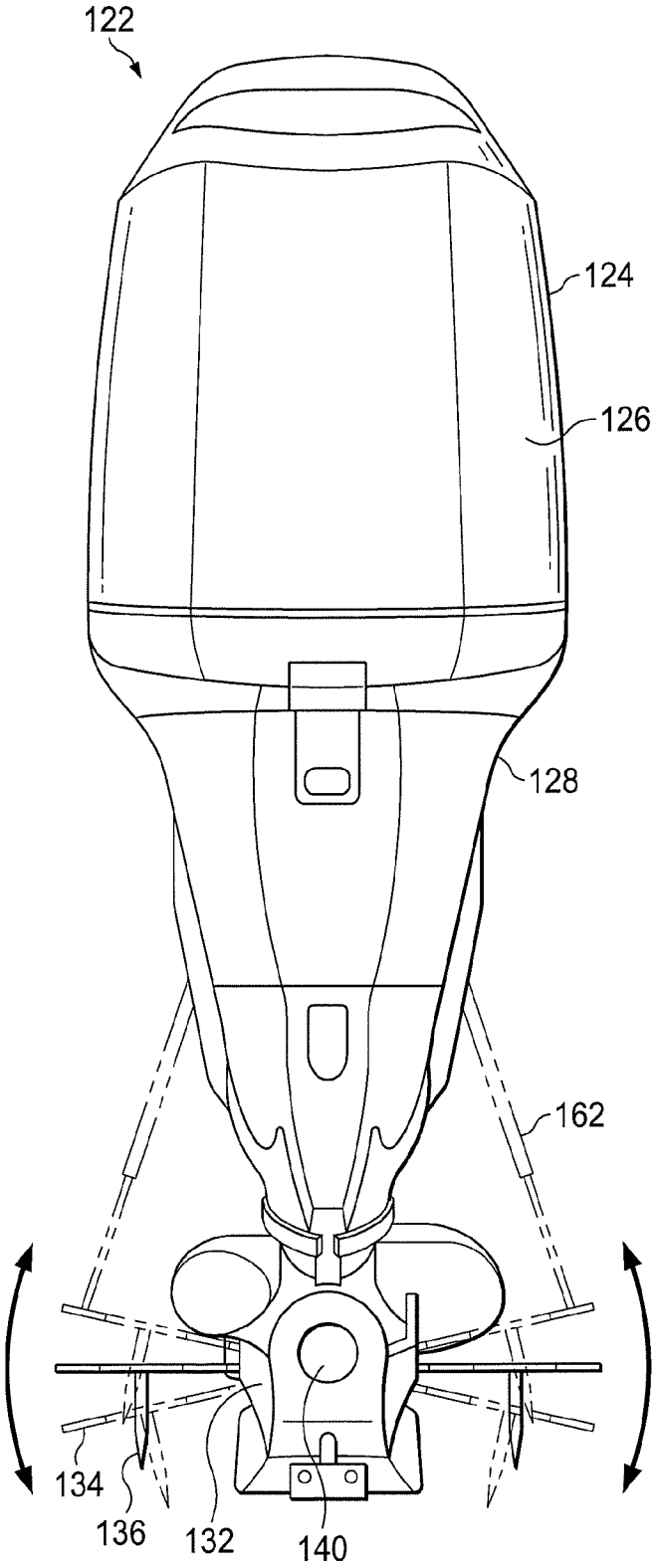
FIG. 5 shows a back profile view of an embodiment of an outboard motor equipped with a pair of stabilizer plates and a pair of rudders where the stabilizer plates can flap with respect to a lower unit of the outboard motor according to this disclosure.

FIG. 5 shows a back profile view of an embodiment of an outboard motor equipped with a pair of stabilizer plates and a pair of rudders where the stabilizer plates can flap with respect to a lower unit of the outboard motor according to this disclosure. In particular, the outboard motor 122 includes a pair of telescoping pneumatic piston-cylinder assemblies 162, each spanning between the midsection 128 and the stabilizer plates 134, although a pair of pivoting mechanical joints is possible, whether additional or alternative thereto, such as where a mechanical joint includes a plurality of bars pivotally attached to each other for inward/outward folding, such as via a pin, a screw, or a bolt/nut. The assemblies 162 oppose each other with the midsection 128 positioned therebetween. The assemblies 162 are independently or dependently, synchronously or asynchronously driven via the power source enclosed via the cowling 126 and can be independently or dependently, synchronously or asynchronously controlled via the instrument panel, such as via the set of input devices 118.

The lower unit 130 includes a pair of lateral slots, such as vertically or diagonally ovoid, rectangular, square, or any other closed shape. The stabilizer plates 134 are attached to the lower unit 130 through such slots such that the stabilizer plates 134 can flap toward the cowling 126 or away from the cowling 126, whether in a clockwise or counterclockwise direction, as the assemblies 162 controllably telescope outward and inward. Therefore, when the stabilizer plates 134 controllably flap via the assemblies 162, the rudders 136 are moved clockwise or counterclockwise, such as up or down, as illustrated in FIG. 5.

In some embodiments, although the lower unit 130 includes the pair of lateral slots, as noted above, a single slot, such as within a wall, or no slot at all is possible, such as when the stabilizer plates 134 are externally attached to the lower unit 130, such as when the stabilizer plates 134 together form a C-shape or a U-shape. For example, the stabilizer plates 134 can be attached to the lower unit 130 without using such slots, such as via a pivoting or gear mechanism externally mounted on the lower unit 130. Likewise, note that other ways of pulling or pushing/dropping the stabilizer plates 134 are possible. For example, the stabilizer plates 134 can flap via a set of gears or pulley systems internal to the lower unit 130 or an electric motor securely housed within the lower unit 130.

Note that this controlled flapping movement is independently or dependently, synchronously or asynchronously controlled at the instrument panel, such as via the set of input devices 118, such as via a set of hydraulic equipment, a set of pneumatic equipment, a set of cables, a set of meshing gears, or any other actuation technology within the boat 100 and within the outboard motor 122 and can be manually powered or, as noted above, independently or dependently, synchronously or asynchronously powered via the power source enclosed via the cowling 126. Further, note that this controlled movement can be manually synchronously or asynchronously controlled, such as via the set of input devices 118, or automatically synchronously or asynchronously controlled, such as a processing circuit, whether local to or remote from the boat 100 or the outboard motor 122, such as based on a set of data feeds from a set of input devices, whether local to or remote from the boat 100 or the outboard motor 122, such as a camera, a sonar, a radar, an ultrasonic sensor, a laser, or others.

Figure 6A:
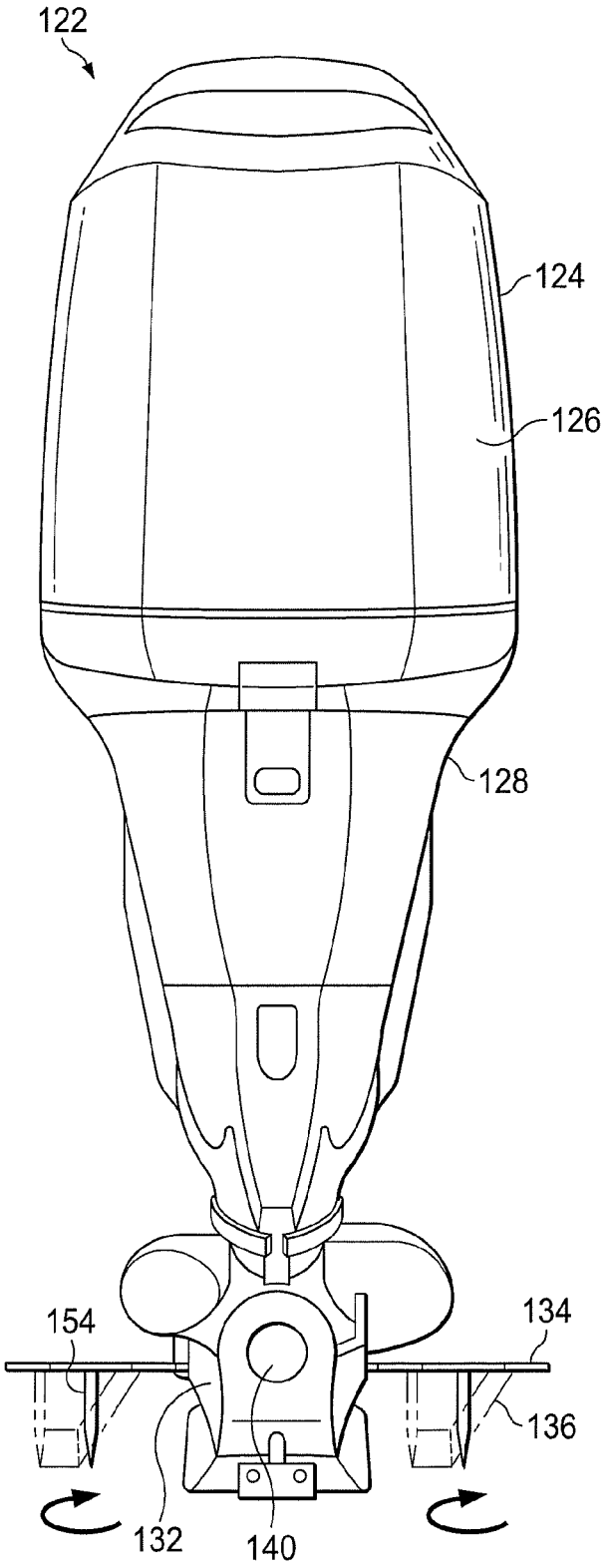
FIGS. 6A-6B show a back profile view of an embodiment of an outboard motor equipped with a pair of stabilizer plates and a pair of rudders where the rudders are able to rotate with respect to the stabilizer plates according to this disclosure.
Figure 6B:
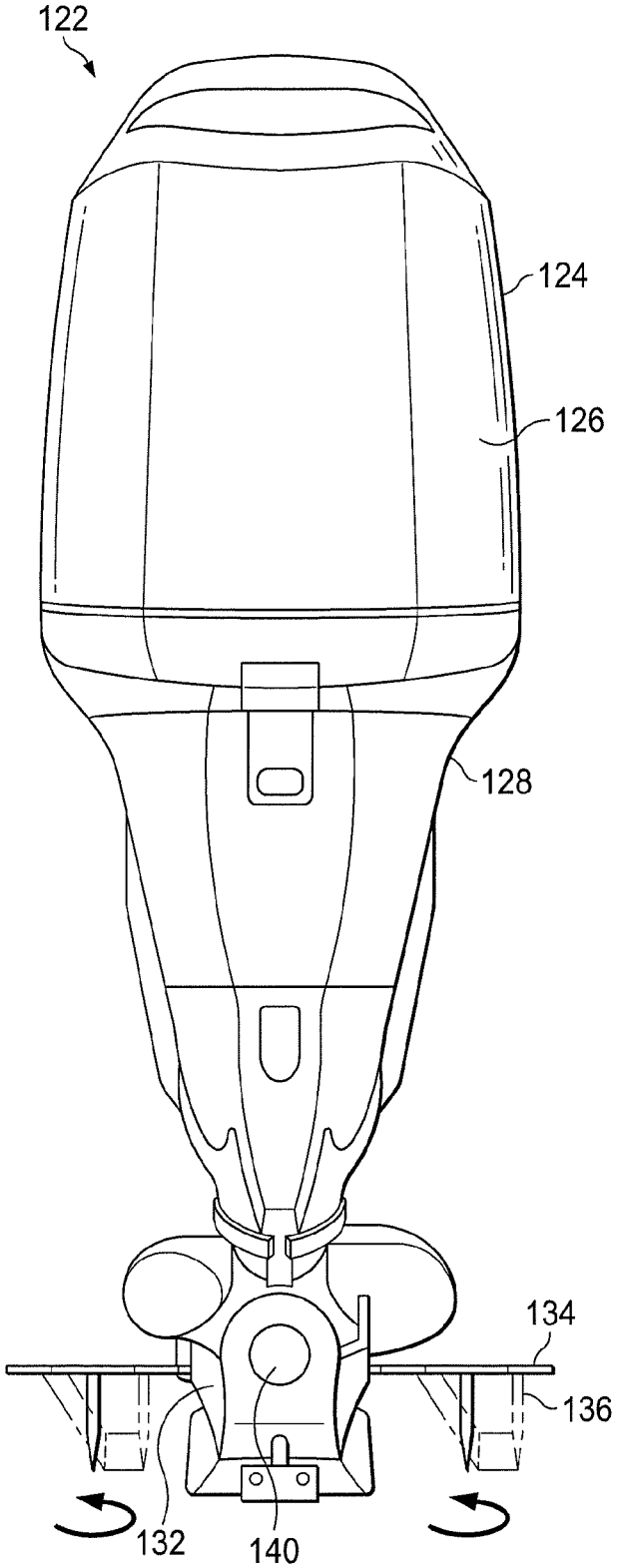

FIGS. 6A-6B show a back profile view of an embodiment of an outboard motor equipped with a pair of stabilizer plates and a pair of rudders where the rudders are able to rotate with respect to the stabilizer plates according to this disclosure. In particular, the lower unit 130 includes a pair of shafts rotationally attached to the stabilizer plates 134, such as perpendicularly or non-perpendicularly, such as acute or obtuse, and rigidly attached to the rudders 136 such that when the shafts controllably rotate about their axes, the rudders 136 are rotated thereby. The shafts can be independently or dependently, synchronously or asynchronously driven by the power source enclosed via the cowling 126 and independently or dependently, synchronously or asynchronously controllably rotated about their respective axes, such as within a predefined rotation range, such as between about 0 and about 90 degrees, although higher amounts are possible, such as about 360 degrees, or freely rotate. The shafts can avoid extending out of the stabilizer plates 134 or the rudders 136 or extend out of the stabilizer plates 134 or the rudders 136. The shafts can be rigid or flexible, solid or perforated and include any suitable material, such as plastic, metal, rubber, wood, or others. The stabilizer plates 134 and the rudders 136 are rigidly secured to the shafts at any points thereof. As such, when the shafts controllably rotate about their axes with respect to the stabilizer plates 134, the rudders 136 are rotated between a set of positions, such as when the lateral sides 154 face the nozzle 140 or avoid facing the nozzle 140.

Note that this controlled movement is independently or dependently, synchronously or asynchronously controlled at the instrument panel, such as via the set of input devices 118, such as via a set of hydraulic equipment, a set of pneumatic equipment, a set of cables, a set of meshing gears, or any other actuation technology within the boat 100 and within the outboard motor 122 and can be manually powered or, as noted above, independently or dependently, synchronously or asynchronously powered via the power source enclosed via the cowling 126. Further, note that this controlled movement can be manually synchronously or asynchronously controlled, such as via the set of input devices 118, or automatically synchronously or asynchronously controlled, such as a processing circuit, whether local to or remote from the boat 100 or the outboard motor 122, such as based on a set of data feeds from a set of input devices, whether local to or remote from the boat 100 or the outboard motor 122, such as a camera, a sonar, a radar, an ultrasonic sensor, a laser, or others.

Figure 7:
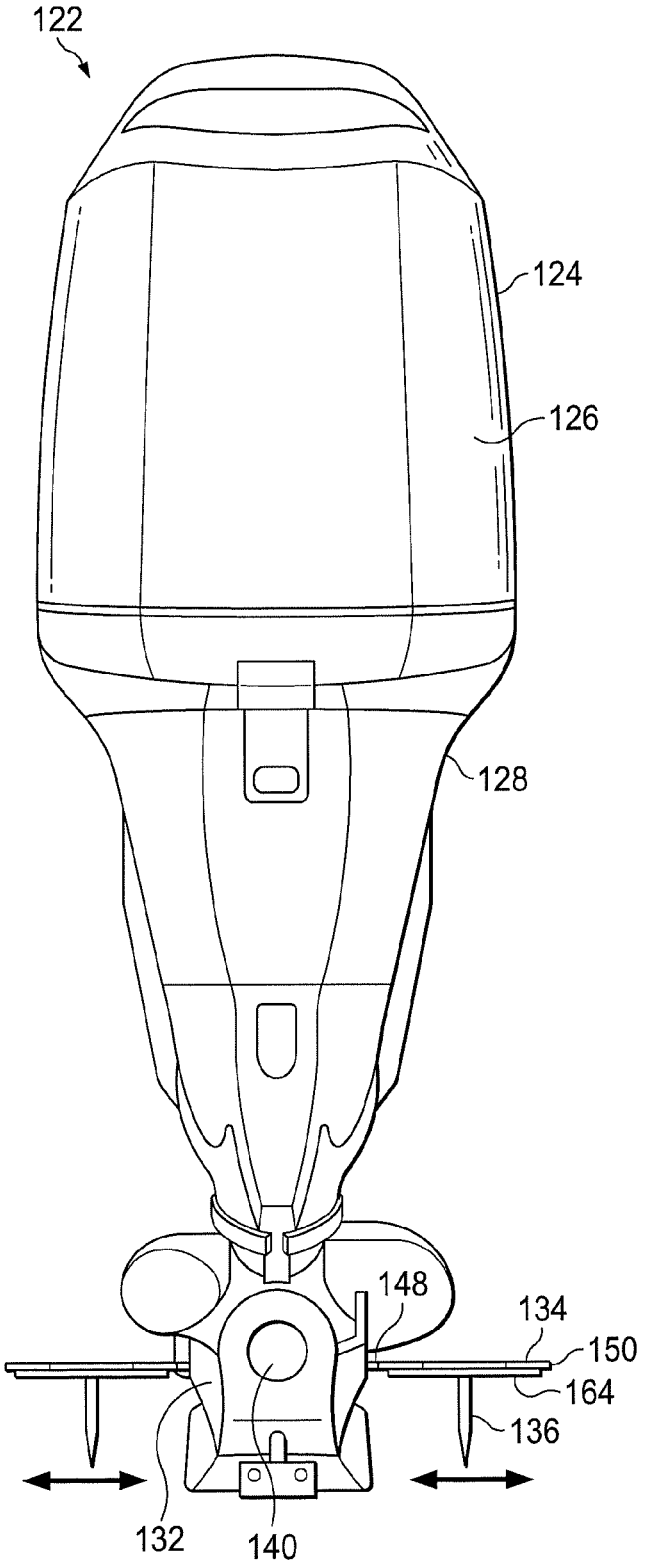
FIG. 7 shows a back profile view of an embodiment of an outboard motor equipped with a pair of stabilizer plates and a pair of rudders where the rudders are able to travel along the stabilizer plates according to this disclosure.

FIG. 7 shows a back profile view of an embodiment of an outboard motor equipped with a pair of stabilizer plates and a pair of rudders where the rudders are able to travel along the stabilizer plates according to this disclosure. In particular, the stabilizer plates 134 includes a plurality of rails/tracks 164 longitudinally extending therein or thereon, such as in a rectilinear, sinusoidal, arcuate, or other manners. Correspondingly, the rudders 136 are operably coupled to the rails/tracks 164 such that the rudders 136 can controllably travel along the rails/tracks 164 between the first end portion 148 and the second end portion 150, as powered manually or via the drive source enclosed via the cowling 126. For example, such travel can be via a wheeled platform, a chain, a timing belt, or others.

Note that this controlled movement is independently or dependently, synchronously or asynchronously controlled at the instrument panel, such as via the set of input devices 118, such as via a set of hydraulic equipment, a set of pneumatic equipment, a set of cables, a set of meshing gears, or any other actuation technology within the boat 100 and within the outboard motor 122 and can be manually powered or, as noted above, independently or dependently, synchronously or asynchronously powered via the power source enclosed via the cowling 126. Further, note that this controlled movement can be manually synchronously or asynchronously controlled, such as via the set of input devices 118, or automatically synchronously or asynchronously controlled, such as a processing circuit, whether local to or remote from the boat 100 or the outboard motor 122, such as based on a set of data feeds from a set of input devices, whether local to or remote from the boat 100 or the outboard motor 122, such as a camera, a sonar, a radar, an ultrasonic sensor, a laser, or others.

Figure 8:
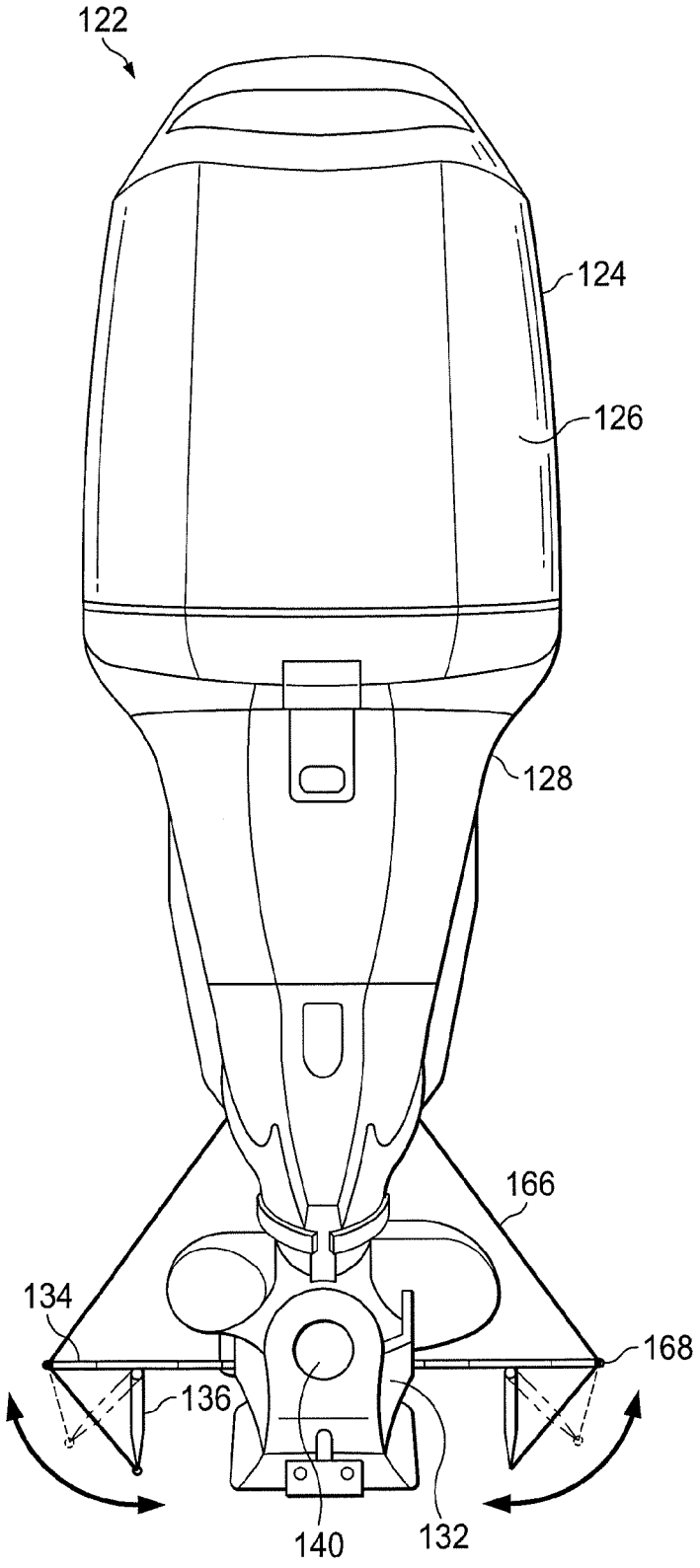
FIG. 8 shows a back view of an embodiment of an outboard motor equipped with a pair of stabilizer plates and a pair of rudders where the rudders are able to pivot with respect to the stabilizer plates according to this disclosure.

FIG. 8 shows a back view of an embodiment of an outboard motor equipped with a pair of stabilizer plates and a pair of rudders where the rudders are able to pivot with respect to the stabilizer plates according to this disclosure. In particular, the outboard motor 122 includes a pair of cables 166 and a pair of pulley wheels 168, where the cables 166 are taut and span between the midsection 128 and the rudders 136 over the pulley wheels 168, with the cables 166 being secured to the rudders 136, such as via an anchor point, such as a closed loop or a bracket, and to the midsection 128, such as via a reel housed within the lower unit 130, which may be manually or automatically driven, as disclosed herein, such as via a set of gears driven via the power source covered via the cowling 126. The cables 166 oppose each other with the midsection 128 positioned therebetween. The cables 166 are independently or dependently, synchronously or asynchronously pulled/rolled or loosened/unrolled via the power source enclosed via the cowling 126 and can be independently or dependently, synchronously or asynchronously controlled via the instrument panel, such as via the set of input devices 118. As such, the rudders 136 can be inwardly/outwardly controllably pivoted via the cables 166 being pulled/rolled (the rudders 136 pivot toward the second end portions 150) or loosened/unrolled (the rudders 136 pivot away from the second end portions 150), as shown in FIG. 8.

In some embodiments, whether additional to or alternative from the cables 166, the outboard motor 122 includes chains, ropes, or belts taut and extending over the pulley wheels 168. In some embodiments, the pulley wheels 168 are absent and the stabilizer plates 134 include a pair of grooves at the second end portions 150, which can be U-shaped or C-shaped, and the cables 166 extend through the grooves. The cables 166 and the pulley wheels 168 can include metal, plastic, wood, rubber, or other suitable materials, and can be identical to or different from each other in any measureable characteristic, such as material, size, braiding, wiring, grooves, sheathing, length, diameter, weight, size, cross-section, weight, or other characteristics. Note that other ways of pivoting the rudders 136 are possible. For example, whether additional to or alternative from the cables 166, the stabilizer plates 134 can internally or externally host a pair of motors or a pair of gear trains, which pivot the rudders 136 toward/away the second end portions 150. In some embodiments, the rudders 136 can be pivoted towards the first end portions 148.

Note that this controlled pivoting movement is independently or dependently, synchronously or asynchronously controlled at the instrument panel, such as via the set of input devices 118, such as via a set of hydraulic equipment, a set of pneumatic equipment, a set of cables, a set of meshing gears, or any other actuation technology within the boat 100 and within the outboard motor 122 and can be manually powered or, as noted above, independently or dependently, synchronously or asynchronously powered via the power source enclosed via the cowling 126. Further, note that this controlled movement can be manually synchronously or asynchronously controlled, such as via the set of input devices 118, or automatically synchronously or asynchronously controlled, such as a processing circuit, whether local to or remote from the boat 100 or the outboard motor 122, such as based on a set of data feeds from a set of input devices, whether local to or remote from the boat 100 or the outboard motor 122, such as a camera, a sonar, a radar, an ultrasonic sensor, a laser, or others.

Figure 9:
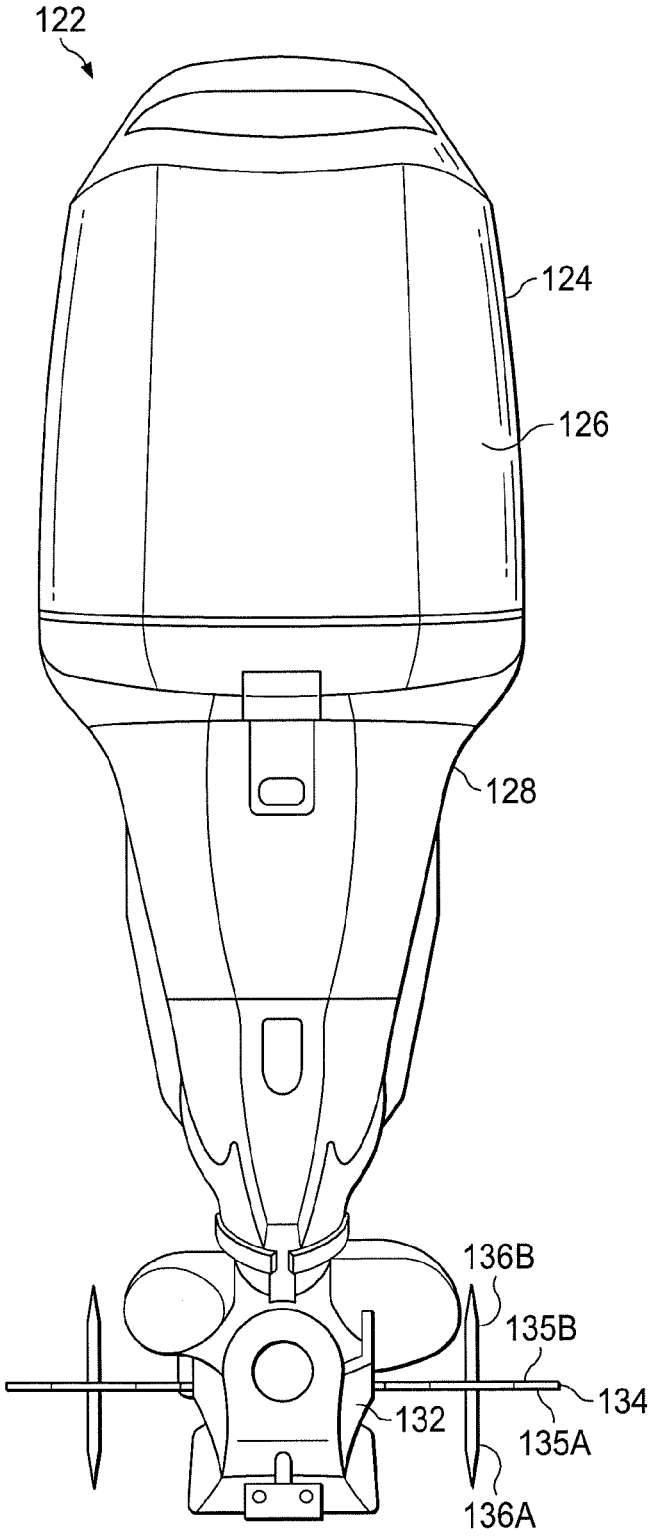
FIG. 9 shows a back view of an embodiment of an outboard motor equipped with a pair of stabilizer plates and a pair of co-aligned rudders extending from each of the stabilizer plates according to this disclosure.
Figure 10:
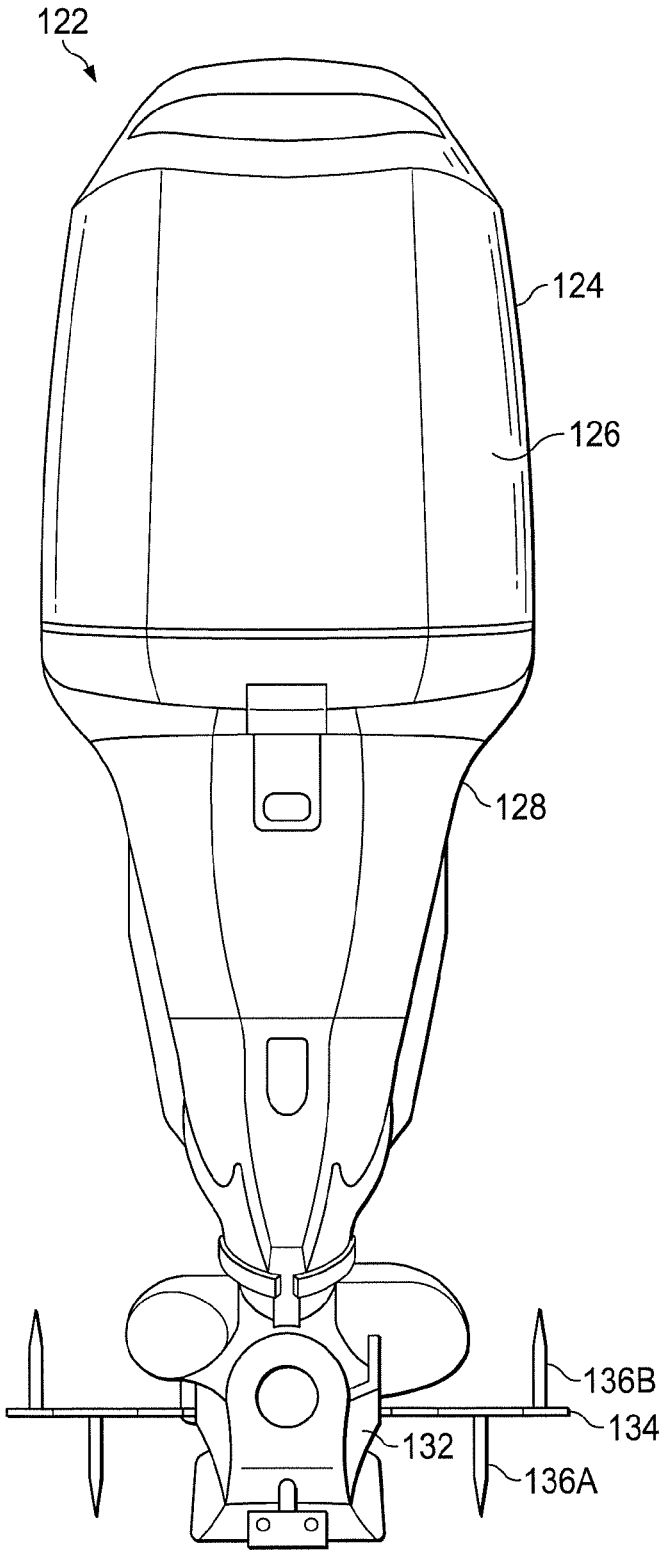
FIG. 10 shows a back view of an embodiment of an outboard motor equipped with a pair of stabilizer plates and a pair of offset rudders extending from each of the stabilizer plates according to this disclosure.

FIG. 9 shows a back view of an embodiment of an outboard motor equipped with a pair of stabilizer plates and a pair of co-aligned rudders extending from each of the stabilizer plates according to this disclosure. FIG. 10 shows a back view of an embodiment of an outboard motor equipped with a pair of stabilizer plates and a pair of offset rudders extending from each of the stabilizer plates according to this disclosure. In particular, at least one of the stabilizer plates 134 includes a lower side 135A and an upper side 135B. The lower side 135A has the rudder 136A extend therefrom, whether directly or indirectly, as disclosed herein, whether perpendicularly or non-perpendicularly, from any point on the side 135A. The upper side 135B has the rudder 136B extend therefrom, whether directly or indirectly, as disclosed herein, whether perpendicularly or non-perpendicularly, from any point on the upper side 135B. The rudder 136A and the rudder 136B can be co-aligned with each other, as shown in FIG. 9. The rudder 136A and the rudder 136B can be offset with each other. Likewise, the rudder 136A can be parallel or non-parallel to the rudder 136B. Although the rudder 136A and the rudder 136B are structurally identical, the rudder 136A and the rudder 136B can be structurally different or different in any other measureable characteristics, such as size, shape, material, weight, orientation, or others.

In some embodiments, at least one of the rudders 136A or 136B or at least one of the stabilizer plates 134 can include a sensor or any other analog or digital device. For example, the sensor can sense any water property, such as temperature, or sense an object thereabout, such as via sound waves, such as via a sonar, or imagery, such as via a camera, such as living, such as a marine being, such as fish, or non-living, such as debris or devices, such as marine bed junk or submarines.

In some embodiments, at least one of the rudders 136A or 136B or at least one of the stabilizer plates 134 includes a light source, such as a light emitting diode (LED), a fluorescent bulb, an incandescent bulb, a black light, or others. The light source is powered via a wire extending between the lower unit 130 and the powerhead section 124 through the midsection 128, where the wire conducts an electric current, whether alternating or direct, from the power source enclosed via the cowling 126 to the light source.

Figure 11A:
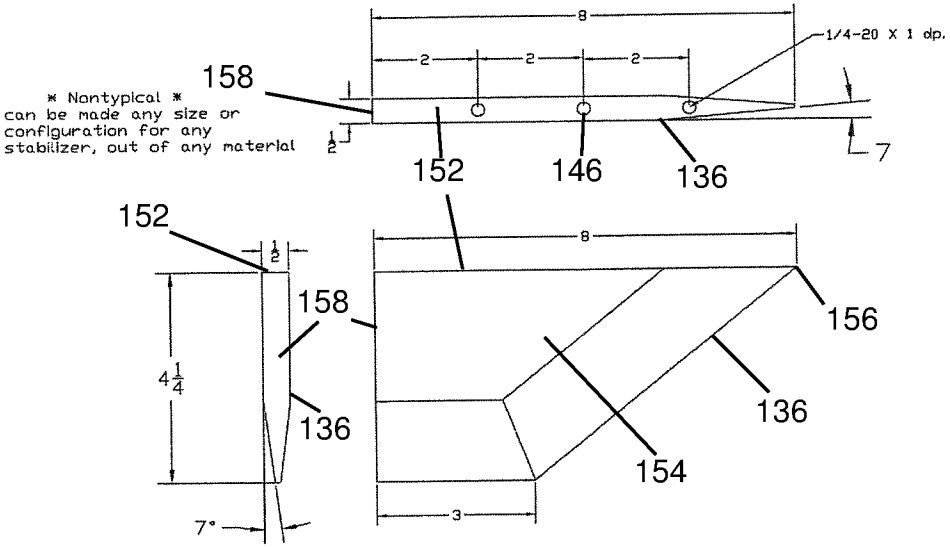
FIGS. 11A, 11B show a schematic view of a rudder and a stabilizer plate according to this disclosure.
Figure 11B:
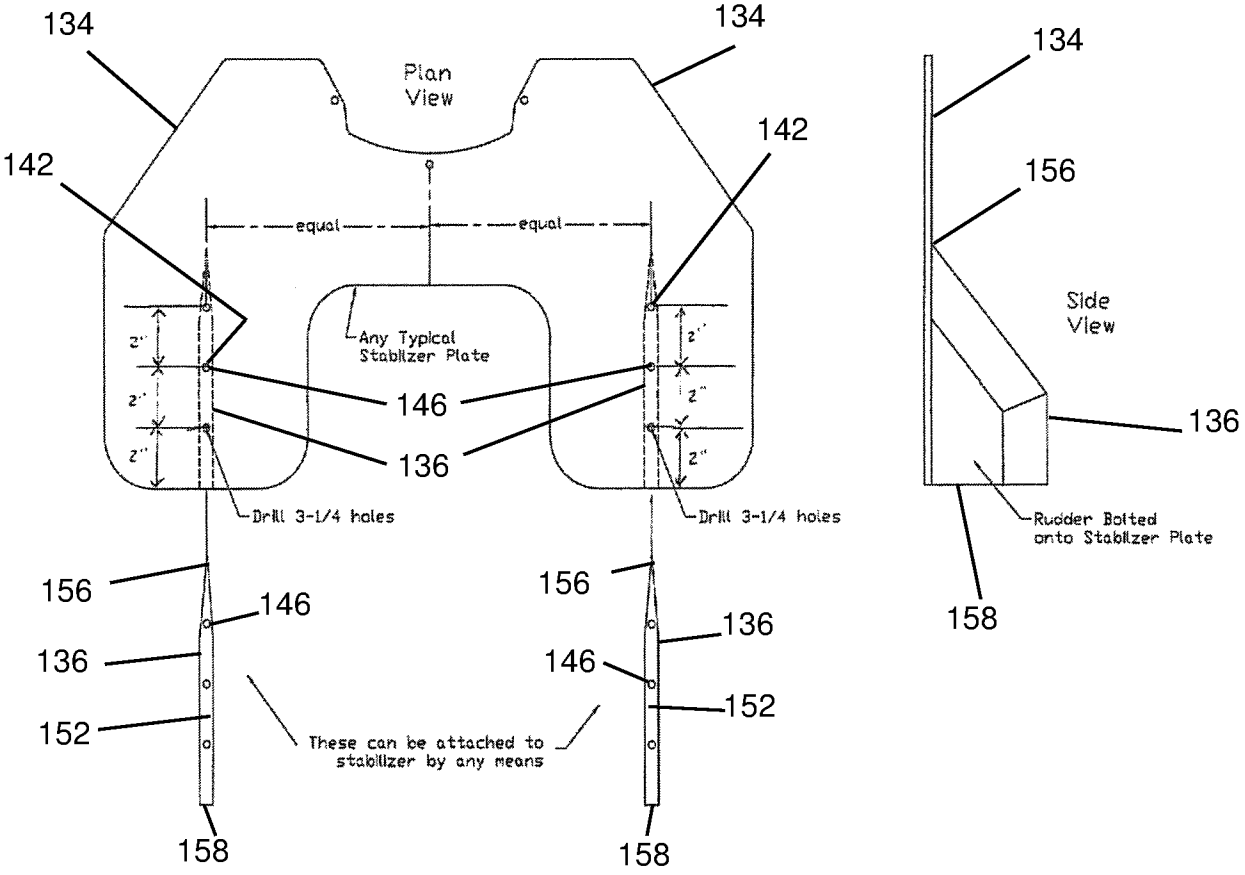

FIGS. 11A, 11B show a schematic view of an embodiment of a rudder and a stabilizer plate according to this disclosure. To mount the rudders 136 using the set of fasteners 144, a centerline of each of the stabilizer plates 134 is found, a set of parallel lines is drawn on either side of a jet nozzle clearance area on each of the stabilizer plates 134 that are of equal distance from the centerline. The rudders 136 have three wells 146 on a long flat end, such as the base 152, that are spaced two inches from a square end, such as the back portion 158, and two inches between each of the wells 146. Likewise, starting from the back portion 158 of the stabilizer plate 134, a user can measure two inches in on each of the parallel lines and drill a bore 142 through the stabilizer plate 134 and measure two inches more and drill another bore 142, and again two more inches and drill the bore 142. Using an 80 degree countersink bit, the user can countersink each bore 142 to fit the fastener 144 until a head of the fastener 144 is flush with the stabilizer plate 134. Note that is describes one example embodiment and other embodiments are possible, as disclosed herein.

In some embodiments, various functions or acts can take place at a given location and/or in connection with the operation of one or more apparatuses or systems. In some embodiments, a portion of a given function or act can be performed at a first device or location, and a remainder of the function or act can be performed at one or more additional devices or locations.

Various corresponding structures, materials, acts, and equivalents of all means or step plus function elements in claims below are intended to include any structure, material, or act for performing that function in combination with other claimed elements as specifically claimed.

This description has been presented for purposes of illustration and description, but is not intended to be fully exhaustive and/or limited to a form disclosed. Many modifications and variations in techniques and structures will be apparent to those of ordinary skill in relevant art without departing from a scope and spirit of this disclosure as set forth in the claims that follow. Accordingly, such modifications and variations are contemplated as being a part of this disclosure. A scope of this disclosure is defined by various claims, which include known equivalents and unforeseeable equivalents at a time of filing of this disclosure.

What is claimed is:

1. An outboard motor comprising:

a midsection, a lower unit, a jet outlet portion, a first stabilizer plate, a second stabilizer plate, a first rudder, and a second rudder, wherein the first stabilizer plate includes a first end portion and a second end portion, wherein the first end portion is proximal to the jet outlet portion, wherein the second end portion is distal to the jet outlet portion, wherein the first rudder extends from the first stabilizer plate between the first end portion and the second end portion, wherein the second rudder extends from the second stabilizer plate, wherein the lower unit includes the jet outlet portion, wherein the lower unit extends between the first stabilizer plate and the second stabilizer plate, wherein at least one of:

the first stabilizer plate and the second stabilizer plate are configured to controllably flap with respect to the lower unit toward the midsection and away from the midsection, or the first rudder and the second rudder are configured to controllably pivot with respect to the first stabilizer plate and the second stabilizer plate toward the midsection and away from the midsection.

2. The outboard motor of claim 1, wherein at least one of the first rudder or the second rudder is flexible.

3. The outboard motor of claim 1, wherein at least one of the first rudder or the second rudder includes a sensor.

4. The outboard motor of claim 1, wherein at least one of the first stabilizer plate and the first rudder are in a first T-shape relationship, or the second stabilizer plate and the second rudder are in a second T-shape relationship.

5. The outboard motor of claim 1, wherein the first rudder is parallel to the second rudder.

6. The outboard motor of claim 1, wherein the first rudder is non-parallel to the second rudder.

7. The outboard motor of claim 1, wherein the first rudder extends from the first stabilizer plate in a first direction and the second rudder extends from the second stabilizer plate in a second direction, wherein the first direction opposes the second direction.

8. The outboard motor of claim 1, wherein the first rudder and the second rudder are structurally different.

9. The outboard motor of claim 1, wherein the first rudder and the second rudder are structurally identical.

10. The outboard motor of claim 1, wherein the second rudder is distal to the lower unit.

11. The outboard motor of claim 1, wherein at least one of the first rudder or the second rudder includes a light source.

12. The outboard motor of claim 11, wherein the light source includes a black light.

13. A method of coupling a rudder to a stabilizer plate of an outboard motor, the method comprising:

accessing an outboard motor including a midsection, a lower unit, a jet outlet portion, a first stabilizer plate, and a second stabilizer plate, wherein the first stabilizer plate includes a first end portion and a second end portion, wherein the first end portion is proximal to the jet outlet portion, wherein the second end portion is distal to the jet outlet portion, wherein the lower unit includes the jet outlet portion, wherein the lower unit extends between the first stabilizer plate and the second stabilizer plate;

coupling a first rudder to the first stabilizer plate between the first end portion and the second end portion; and extending a second rudder from the second stabilizer plate, wherein at least one of:

the first stabilizer plate and the second stabilizer plate are configured to controllably flap with respect to the lower unit toward the midsection and away from the midsection, or the first rudder and the second rudder are configured to controllably pivot with respect to the first stabilizer plate and the second stabilizer plate toward the midsection and away from the midsection.

14. A method of operating a boat, the method comprising:

moving a boat with an outboard motor, wherein the outboard motor is equipped with a midsection, a lower unit, a jet outlet portion, a first stabilizer plate, a second stabilizer plate, a first rudder, and a second rudder, wherein the first stabilizer plate includes a first end portion and a second end portion, wherein the first end portion is proximal to the jet outlet portion, wherein the second end portion is distal to the jet outlet portion, wherein the first rudder extends from the first stabilizer plate between the first end portion and the second end portion, wherein the second rudder extends from the second stabilizer plate, wherein the lower unit includes the jet outlet portion, wherein the lower unit extends between the first stabilizer plate and the second stabilizer plate, wherein at least one of:

the first stabilizer plate and the second stabilizer plate are configured to controllably flap with respect to the lower unit toward the midsection and away from the midsection, or the first rudder and the second rudder are configured to controllably pivot with respect to the first stabilizer plate and the second stabilizer plate toward the midsection and away from the midsection; and steering the boat with at least one of the first rudder or the second rudder.

15. The outboard motor of claim 1, wherein the first stabilizer plate and the second stabilizer plate are configured to controllably flap with respect to the lower unit toward the midsection and away from the midsection.

16. The outboard motor of claim 1, wherein the first rudder and the second rudder are configured to controllably pivot with respect to the first stabilizer plate and the second stabilizer plate toward the jet outlet portion and away from the jet outlet portion.

* * * * *